US005200566A

United States Patent [19]

Shimaya

[11] Patent Number: 5,200,566

[45] Date of Patent: Apr. 6, 1993

[54] ELECTRONIC MUSICAL INSTRUMENT WITH AD-LIB MELODY PLAYING DEVICE

[75] Inventor: Hideaki Shimaya, Hamamatsu, Japan

[73] Assignee: Yamaha Corporation, Hamamatsu, Japan

[21] Appl. No.: 634,029

[22] Filed: Dec. 26, 1990

[30] Foreign Application Priority Data

Dec. 26, 1989 [JP] Japan ..... 1-339272

[51] Int. Cl.[5] ..... G10H 7/00; G04B 13/00; A63H 5/00

[52] U.S. Cl. ..... 84/609; 84/610; 84/612

[58] Field of Search ..... 84/609-611, 84/613, 634, 637, 649, 650

[56] References Cited

U.S. PATENT DOCUMENTS

| | | | |
|---|---|---|---|
| 4,344,345 | 8/1982 | Sano | 84/Dig. 12 X |
| 4,602,546 | 7/1986 | Shinohara | 84/609 |
| 4,630,518 | 12/1986 | Usami | 84/610 |
| 4,699,039 | 10/1987 | Oguri et al. | 84/622 |
| 4,742,748 | 5/1988 | Tateishi | 84/611 |
| 4,939,974 | 7/1990 | Ishida et al. | 84/609 |
| 5,095,799 | 5/1992 | Wallace et al. | 84/609 |

FOREIGN PATENT DOCUMENTS

| | | | |
|---|---|---|---|
| 0179085 | 7/1989 | Japan | 84/609 |
| 2226177 | 6/1990 | United Kingdom | 84/609 |

*Primary Examiner*—William M. Shoop, Jr.
*Assistant Examiner*—Jeffrey W. Donels
*Attorney, Agent, or Firm*—Spensley Horn Jubas & Lubitz

[57] ABSTRACT

An electronic musical instrument is provided with an ad-lib melody data storage device for storing ad-lib melody data and an ad-lib switch so that, when the ad-lib switch is turned on, it will read the ad-lib melody data to automatically play an ad-lib melody. The access to the ad-lib melody data is performed according to a clock value, and the instrument is adapted to count up the clock value while the ad-lib switch is on, and moreover to hold or count up without resetting also while the ad-lib switch is off. This arrangement allows the reading start address to be varied each time the ad-lib switch is turned on, enabling ad-lib melodies to be played in great variety.

14 Claims, 13 Drawing Sheets

FIG. 3 (A)

| PITCH | -- C2 -- | C3 -- | B3 | C4 | C#4 -- | C5 -- | C6 -- |
|---|---|---|---|---|---|---|---|
| KEY CODE | -- 36 -- | 48 -- | 59 | 60 | 61 -- | 72 -- | 84 -- |

FIG. 3 (B)

| ADDRESS | DATA | NOTE LENGTH |
|---|---|---|
| 0 | 64 | 𝅝 |
| 1 | 48 | 𝅗𝅥. |
| 2 | 32 | 𝅗𝅥 |
| 3 | 24 | ♩. |
| 4 | 16 | ♩ |
| 5 | 12 | ♪. |
| 6 | 8 | ♪ |
| 7 | 4 | 𝅘𝅥𝅯 |
| 8 | 2 | 𝅘𝅥𝅰 |
| ⋮ | ⋮ | ⋮ |

FIG. 3 (C)

| ADDRESS | DATA | PITCH |
|---|---|---|
| 1 | 30 | F#1 |
| 2 | 36 | C2 |
| 3 | 42 | F#2 |
| 4 | 48 | C3 |
| 5 | 54 | F#3 |
| 6 | 60 | C4 |
| 7 | 66 | F#4 |
| 8 | 72 | C5 |
| 9 | 78 | F#5 |
| A | 84 | C6 |

FIG. 3 (D)

| ADDRESS | DATA |
|---|---|
| 1 | -6 |
| 2 | -5 |
| 3 | -4 |
| 4 | -3 |
| 5 | -2 |
| 6 | -1 |
| 7 | 0 |
| 8 | +1 |
| 9 | +2 |
| A | +3 |
| B | +4 |
| C | +5 |
| D | +6 |
| E | +7 |

FIG. 3 (E)

| (TYPE) | CHORD TYPE \ ROOT DIFFERECE | 0 | 1 | 2 | 3 | 4 | 5 | 6 | 7 | 8 | 9 | 10 | 11 |
|---|---|---|---|---|---|---|---|---|---|---|---|---|---|
| 0 | M | | | | | | -1 | | | | | 2 | |
| 1 | M | | | | | -1 | | | | | | 2 | -1 |
| 2 | 7TH | | | | | | | | | | | | |
| 3 | M7 | | | | | -1 | | | | | | | |
| 4 | M7 | | | | | | -1 | | | | | 1 | |
| 5 | AUG | | | | | | 1 | | 1 | | | 2 | |
| 6 | DIM | | | | | -1 | | | -1 | | | -1 | |

FIG. 4

| |
|---|
| ADLB |
| ADPNT |
| ASS |
| CLK |
| DKC |
| EVT |
| KC |
| NOTE |
| RDCNT |
| REFKC |
| RHY |
| ROOT |
| SNDEN |
| TNAD |
| TNML |
| TYPE |

ELECTRONIC MUSICAL INSTRUMENT WITH AD-LIB MELODY PLAYING DEVICE

BACKGROUND OF THE INVENTION

1. Field of the Invention

This invention relates to electronic musical instruments capable of generating the tones of ad-lib melodies while the instrument is played.

2. Description of the Prior Art

In recent years there have been developed electronic musical instruments provided with some functions that can be used with pleasure even by the inexperienced in musical instruments. One of such functions is that additional tones are automatically generated according to the tones actually played by a player so as to enhance the played musical tones. Examples of this type of function include automatic accompaniment function, by which chords and rhythm are automatically added to a melody played by a player, and ad-lib function, by which a melody having a smaller number of musical notes is additionally given fine grace notes.

The ad-lib function in general is exercised through the steps of reading previously stored ad-lib melody data according to the rhythm involved while the instrument is played, transposing the data so as to match the tune of the playing, and generating the resulting tones. With conventional ad-lib devices, however, since melody data is read starting with the leading head thereof each time ad-lib function is initiated, the resulting ad-lib performance may sound monotonous.

SUMMARY OF THE INVENTION

Accordingly, it is the object of the present invention to provide an electronic musical instrument adapted to keep the readout of ad-lib melodies from sounding monotonous in exercising such an ad-lib function.

The electronic musical instrument according to the present invention is so constructed that when a particular switch is turned on, the reading of ad-lib melody data is started with a data location corresponding to the clock value at that time and the data is read on according as the clock value makes steps, thus an ad-lib melody being generated as tones. The clock value is counted up along with the progress of an ad-lib melody while the above-mentioned particular switch is held in the on position and moreover, while automatic accompaniment means is operating, the clock value is also counted up. This arrangement allows the clock value to be indefinite at the time the particular switch is turned on, thereby making variable the starting point for reading the ad-lib melody data with the result of ad-lib melodies full of variety.

BRIEF DESCRIPTION OF THE DRAWINGS

FIG. 1 (A) shows a block diagram of the control unit of an electronic keyboard instrument embodying the present invention and FIG. 1(B) shows a diagram schematically showing the arrangement of the control panel of the same;

FIGS. 3(A) to 3(E) show various types of tables;

FIG. 4 is a view showing registers;

DETAILED DESCRIPTION OF THE PREFERRED EMBODIMENTS

Figure 1:
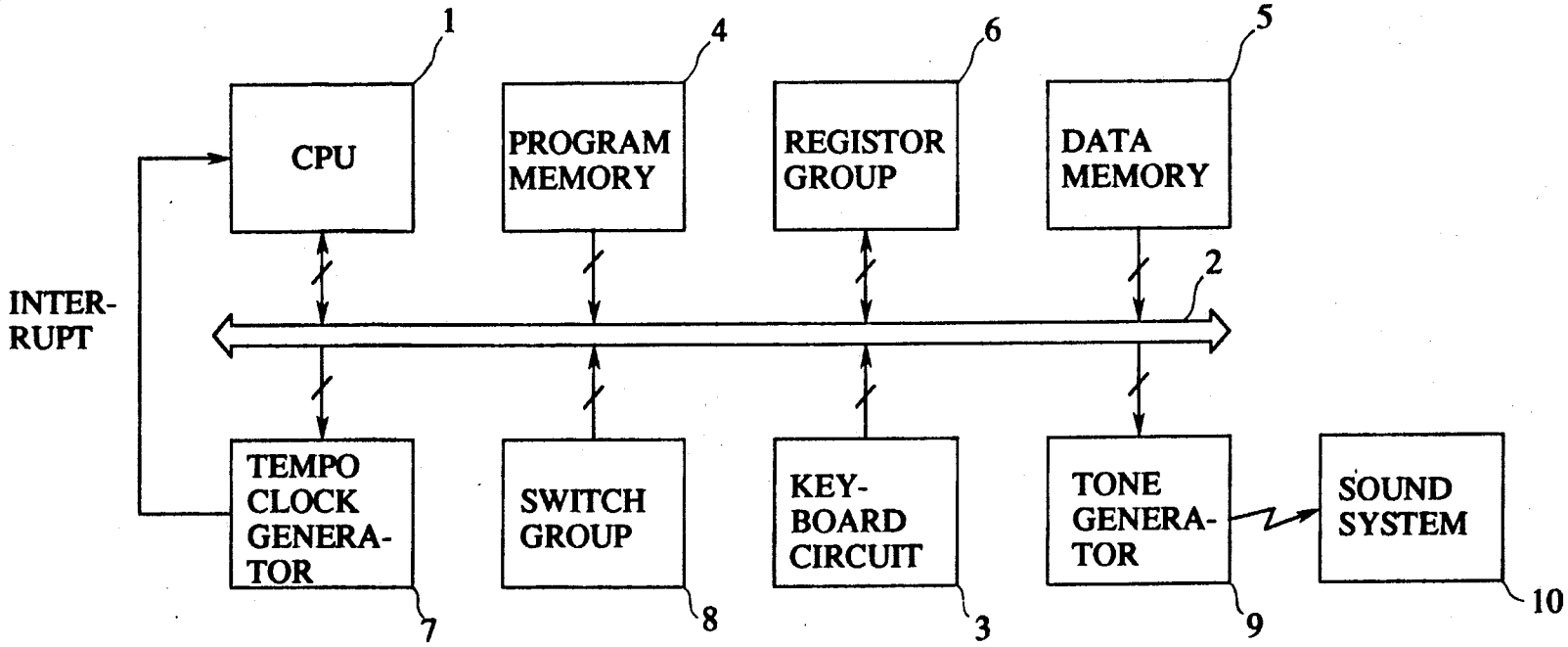
Figure 1:
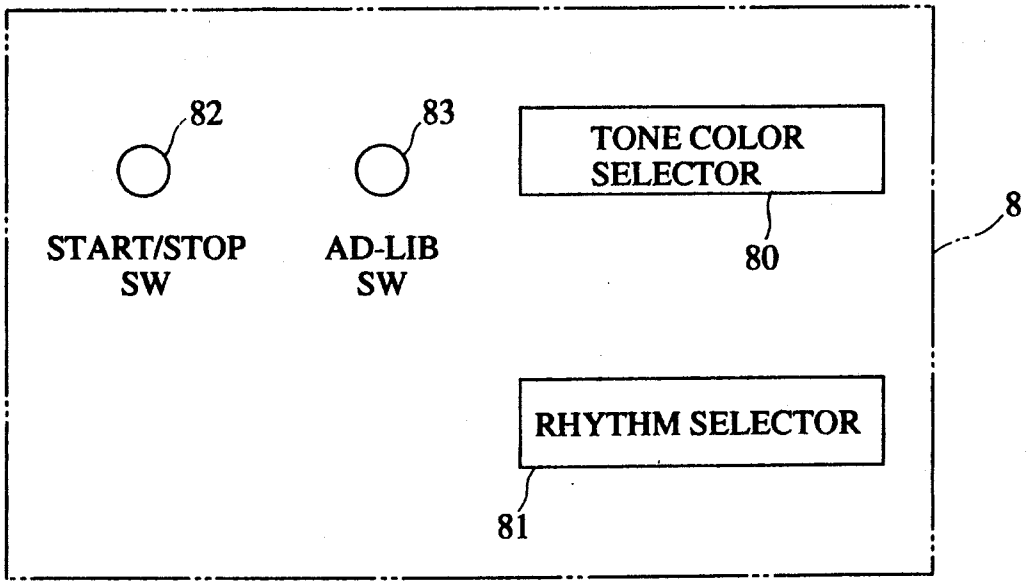

An electronic keyboard instrument embodying the present invention is now described with reference to the accompanying drawings. The electronic keyboard instrument is provided with a keyboard 3 ranging over about 5 octaves, an ad-lib switch 83, a start/stop switch 82 (i.e. automatic accompaniment switch), a tone color selector switch group 80 and a rhythm selector switch group 81. The start/stop switch 82 is a toggle switch, while the ad-lib switch 83 is a push-on switch.

With the start/stop switch 82 off, the instrument is in the normal mode, in which it forms tone signals to generate tones according to the playing operation of the keyboard 3. With the start/stop switch 82 on, in turn, the instrument is in the automatic accompaniment mode, in which it detects chords depending on depressed keys within the range of 1 octave of the lower tone side of the keyboard 3 to generate chords as well as it generates rhythm tones of a selected rhythm.

Ad-lib data (i.e. ad-lib melody data) is previously stored in data memory, ready to be automatically read and generated as tones when the ad-lib switch 83 is turned on. The ad-lib switch 83 is disposed on the right side of the keyboard so as to be operated by right hand. Along with this operation, the keyboard is to play chords by left hand.

FIG. 1(A) is a block diagram of the control unit of an electronic keyboard instrument embodying the present invention. The electronic keyboard instrument is controlled by a CPU 1, which is connected with circuits via a bus 2. To the bus 2 there are connected a keyboard circuit 3, program memory 4, data memory 5, a register group 6, a tempo clock generator 7, a switch group 8, and a tone generator 9. The keyboard circuit 3 contains a keyboard ranging over about 5 octaves, serving as a circuit that detects the on/off state and touch strength of the individual keys making up the keyboard. The program memory 4 has programs stored therein as shown by the flow charts described later. The data memory 5 has tone data, various types of tables (see FIGS. 3(A) to 3(E)), ad-lib data (see FIG. 8) and the like stored therein. The register group 6 has various types of registers set therein as shown in FIG. 4. The tempo clock generator 7 serves to generate a clock signal according to a specified tempo, applying interrupt into the CPU1 for every clock timing. The switch group 8 has switches provided to the control panel of the instrument and circuits for detecting the on/off state thereof.

Figure 2:
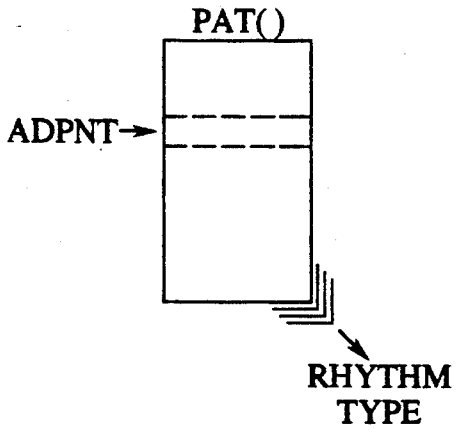
FIGS. 2(A) and 2(B) show the formats of ad-lib data.
Figure 2:
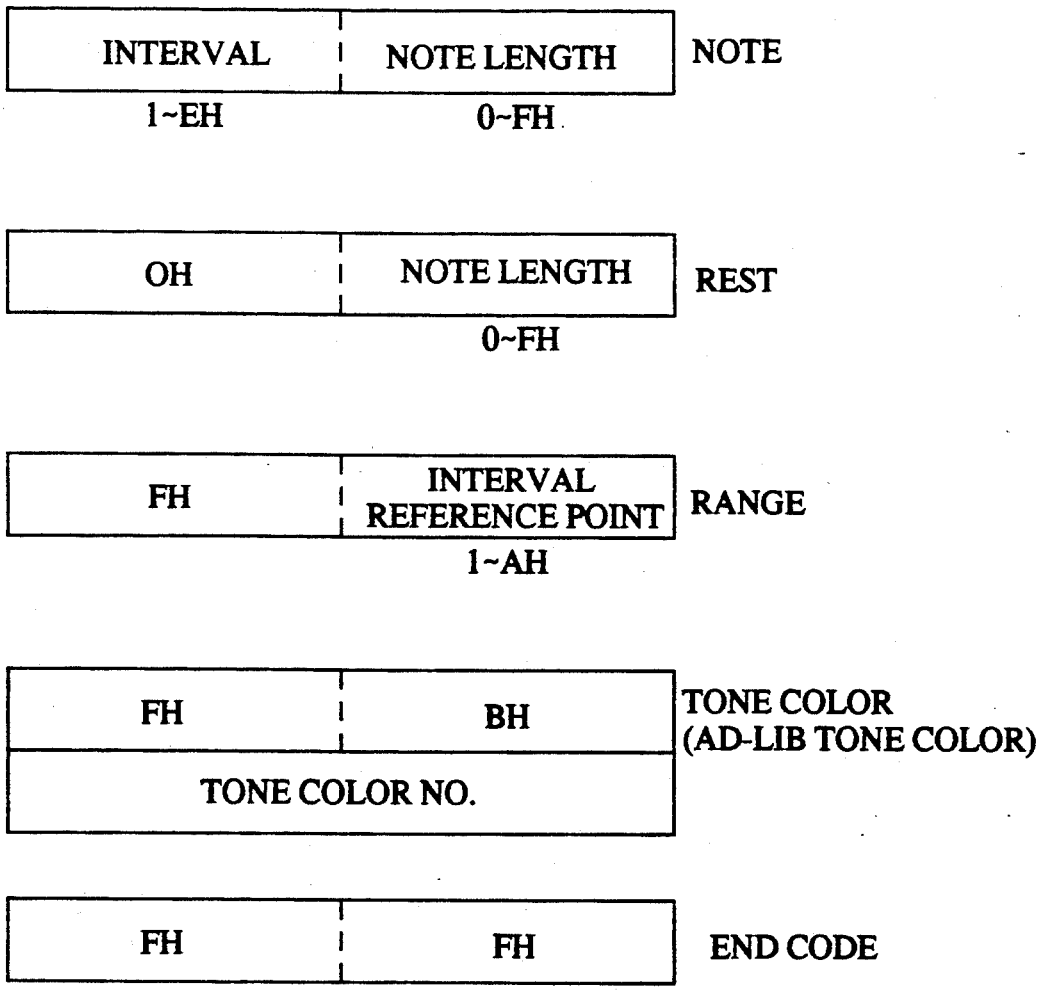
Figure 8:
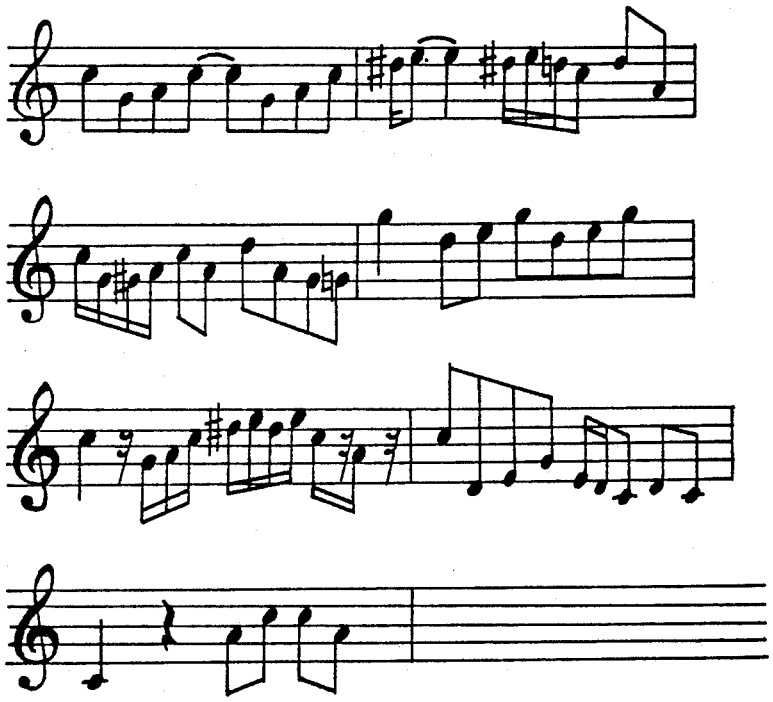
FIG. 8 is a view showing an example of ad-lib melodies.

FIGS. 2(A) and 2(B) is a view showing the arrangement of the ad- lib data stored in the data memory 5 of the aforementioned control unit. FIG. 2 (A) shows the arrangement of the storage area for the ad-lib data. The ad-lib data stored therein is, for example, the data for tone-generating such melodies of a plurality of measures as shown in FIG. 8, and like ad-lib data is stored in a plurality of types in correspondence to various rhythm patterns. Each type of ad-lib data, being composed of leading control data and succeeding melody data, is read starting with the leading head of melody data when rhythm type or the like is changed and a corresponding ad- lib pattern is read. That is, the ad-lib pointer (ADPNT) is set in the order starting with the leading address of the melody data.

FIG. 2 (B) shows the formats of individual pattern data contained in the ad-lib data. Each pattern data is made up fundamentally of 8 bits, the upper 4 bits of which represent the type of data and the lower 4 bits the contents of the data.

If the upper 4 bits are any of 1 to EH, they stand for note data, where the value thereof represents a predetermined musical interval (i.e. a difference in pitch from an interval reference point, described later; see FIG. 3 (D)). On the other hand, the lower 4 bits of note data represent the length of the note (see FIG. 3 (B)).

If the upper 4 bits are 0H, they stand for rest data, while the lower 4 bits represent the length of the rest as in note data.

In other cases, the upper 4 bits of FH stand for control data involved in a piece of music, while the lower 4 bits of 1 to AH represent range data and otherwise, BH does ad-lib tone data, FH an end code. The range data serves to determine an interval reference point, allowing note pitches to be described as differences (represented by numbers of semitones) from the so-designated interval reference point (a specific pitch; see FIG. 3 (C)) for the data that follows the range data. If the range of a piece of music varies to a large extent, the interval reference point will be moved up to the range that enables the music to be described.

The end code is a code that is written into the last address of ad-lib data. When this data is read in the course of ad-lib playing, the pointer ADPNT will move up to the leading head of melody data from the above address to continue reading data.

FIG. 3 (A) through (E) shows various types of tables to be stored in the data memory 5 mentioned before.

FIG. 3 (A) is a key code table, which is referenced to convert an event key into key code data on the occurrence of a key on/off event.

FIG. 3 (B) is a note length table, which stores various types of musical notes, such as whole notes, as 2-digit numerical values corresponding thereto. These numerical values are assigned to the lower 4 bits of note data for storage. This way of representing musical notes allows the data to be simplified as compared with such a way that note length is represented directly by number of clocks.

FIG. 3 (C) is an interval reference point table. Since the pitches of the note data mentioned above are stored as differences in intervals from the pitch that makes an interval reference point, the data stored in this table is used to designate an interval reference point for the pitch.

FIG. 3 (D) is an interval difference table, which is used to decode the pitches of note data. More specifically, since pitches are described in the form of codes that indicate intervals from an interval reference point (number of semitones) with respect to ad-lib data, it is this table that converts the codes into numbers of semitones.

FIG. 3 (E) is a pitch-name conversion table. The aforementioned ad-lib data is stored one piece for each rhythm, which piece of data is used for any tone only if the rhythm is of the same. This means that any change in the keynote will involve a transposition in accordance therewith. It is to be noticed here that the ad-lib data, being of a general major key, would not accord with a piece of music if tone-generated as it is for a minor key or minor chord involved in the music. Accordingly, when a type of chord such as major or minor is changed, a pitch (e.g. "mi") depending on which the type of the chord is defined need to be shifted so as to match the type of chord. For the tone generation of an ad-lib melody, the table is referenced to determine the amount of shifting depending on the pitch and type of chord thereof.

FIG. 4 is a view showing registers to be set in the register group 6.

ADLB is an ad-lib flag register. With this flag set, the ad-lib mode is set to perform the ad-lib automatic playing.

ADPNT is an ad-lib pattern pointer. Ad-lib pattern data is read according to the address of this pointer.

ASS is an assignment channel register. With an instruction for the tone-generation, a tone-generation channel of the tone source circuit is assigned to generate the tone, being set into this register.

CLK is a tempo clock register, which is counted up for each clock interrupt and, being reset repeatedly every 64 counts, continues the counting. That is, the CLK is counted up for every 1/16 beat, being reset for every one measure (64). In the present embodiment, pieces of music involved are limited to those of 4 beats for a simplified explanation.

DKC is an ad-lib key code register, which is to store a key code determined by adding the interval data contained in note data and the pitch of the interval reference point.

EVT is an ad-lib data buffer, where the data read out of the ad-lib memory is temporarily stored.

KC is a tone-generation key code register, which is to have input of the data that the contents of the DKC are modified in tone type or by reference of the pitch-name conversion table and the like.

NOTE is an ad-lib pitch-name register, which is to store the names of notes of an ad-lib melody and, based on the contents thereof, the pitch-name conversion table is referenced.

RDCNT is a note-length down counter. When a note of an ad-lib melody is tone-generated, the note length thereof is set into this counter. The content of the counter is counted down for each clock interrupt, ending the tone-generation of the note when the count value becomes 0.

REFKC is an interval reference point key code register, where a key code is to be set that are read out of the interval reference table based on the codes (addresses) contained in range data.

RHY is a rhythm type register, which is to store a rhythm number selected with the rhythm selector switch group 81.

ROOT is a root register, which is to store the root of a detected chord as a half note.

RUN is a run flag register, which is set or reset depending on the on/off state of the start/stop switch 82. While this flag is set, the automatic accompaniment is performed with the generation of rhythm and chord tones.

SNDEN is an ad-lib tone-generation continuing flag register. Even if the ad-lib mode is canceled, the ad-lib tone-generation is continued while this flag is set. The flag is reset when the ad-lib data reaches a bar after the cancellation of the ad-lib mode.

TNAD is an ad-lib tone register, where tone data read out of ad-lib pattern data is to be set.

TNML is a melody tone register, which is to store a tone number selected with the tone selector switch group 80.

TYPE is a chord type register, which is to store the type of a detected chord, such as major, minor, or 7th.

Figure 5A:
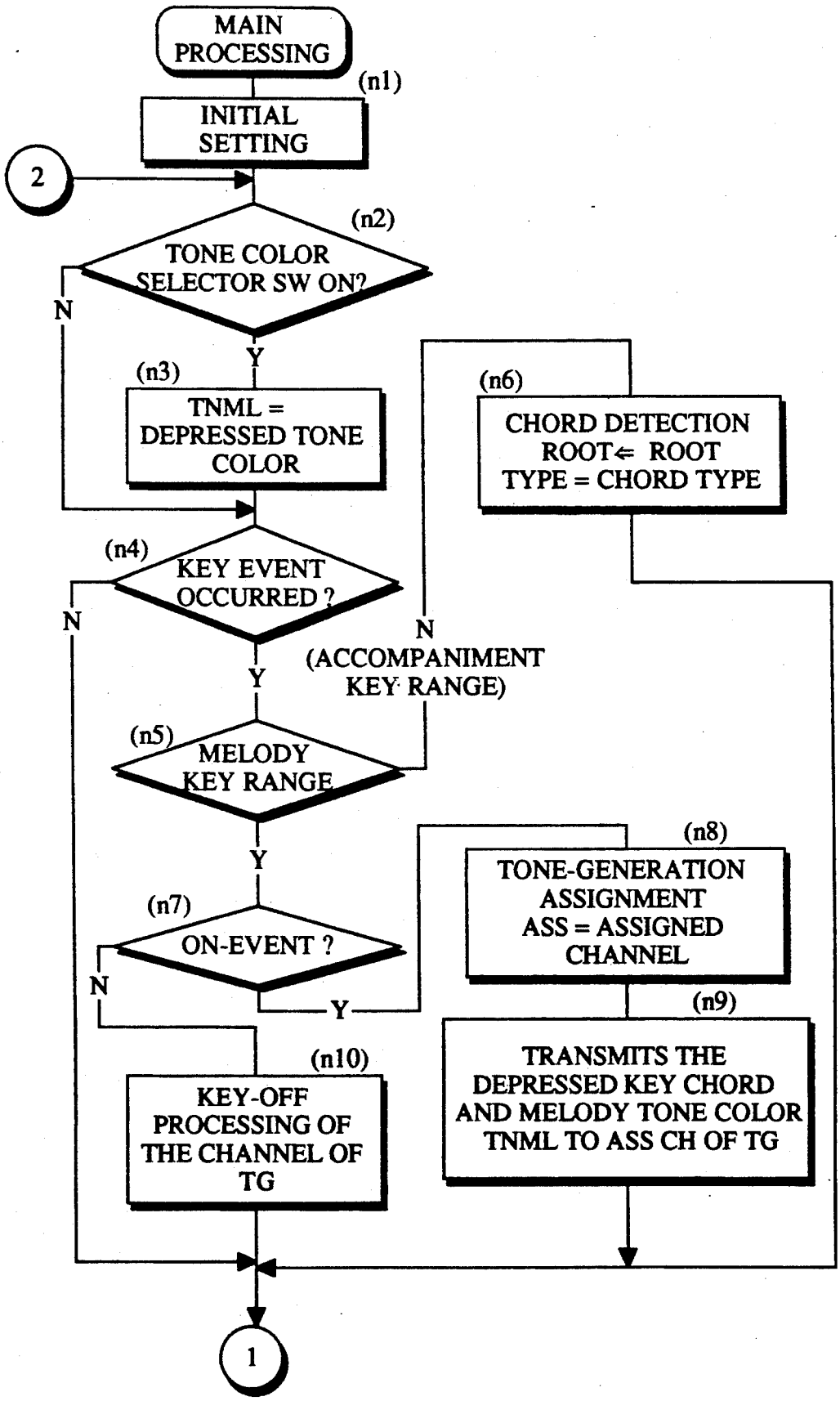
FIGS. 5(A),5(B),5(c),6(A),6(B),and 7 are flow charts showing the operation of the control unit.
Figure 5B:
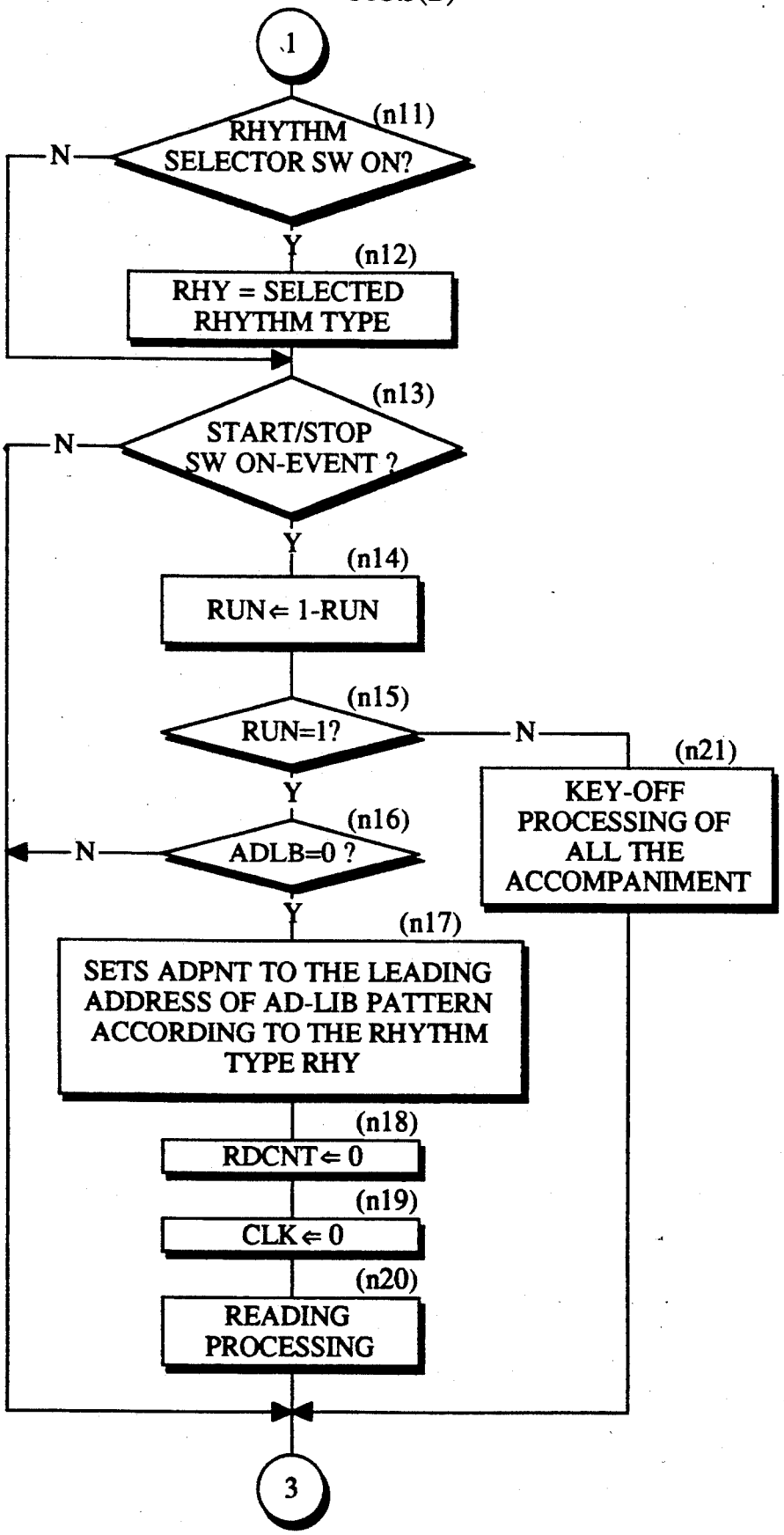
Figure 5C:
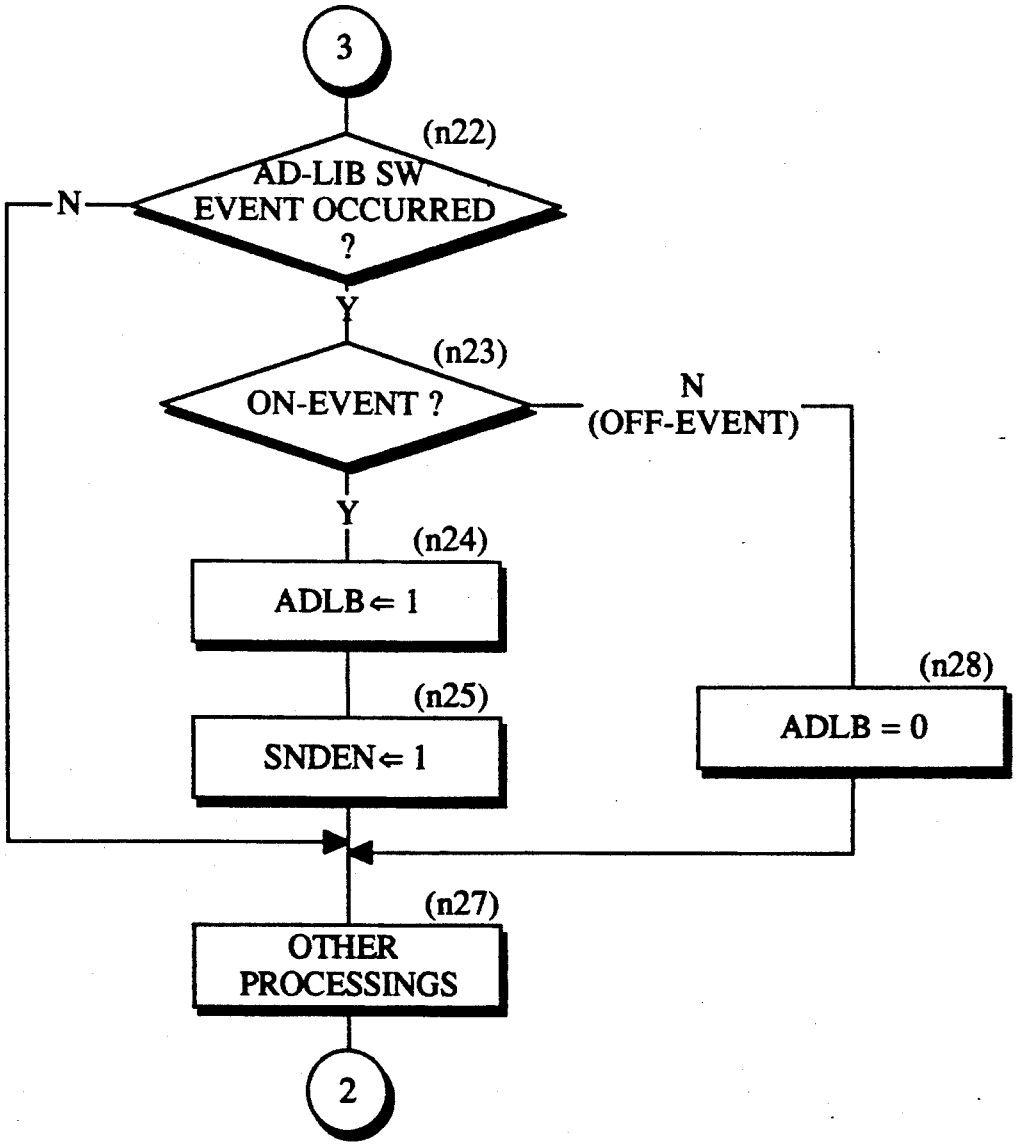

FIGS. 5(A) through 7 are flow charts showing the operations of the control unit of the electronic keyboard instrument. FIGS. 5(A) to 5(C) shows the operation for main processing. When the instrument is powered on, initial setting operation is first executed, enabling the electronic instrument to be played. The initial setting operation includes clearing registers, reading preset data and the like. Subsequent to this, the control unit decides whether or not any event has occurred such as an on-event (n2) of the tone color selector switch, a key event (n4), an on-event of the rhythm selector switch (n11), an on-event of the start/stop switch (n13), and an ad-lib switch event (n22), and when any of these are detected, executes corresponding operation.

When the tone selector switch 80 is turned on, the control unit takes a sequence of n2 to n3, storing selected tone data into the TNML.

With a key event, the unit takes a sequence of n4 to n5, deciding whether the key event is within the melody key range or not. Due to the fact that a key event out of the melody key range falls within the accompaniment key range, a chord is detected from the state of key-depressing within the accompaniment key range resulting from the key event (n6). The root of the detected chord is stored into the root register ROOT, while the type of the chord is stored into the chord type register TYPE. When a key event occurs within the melody key range, the control unit takes a sequence of n5 to n7, deciding whether the event is an on-event or not. If it is an on-event, a tone-generation channel is assigned to the key and the assigned channel is set into the ASS register (n8), transmitting the key code, tone color data, and the like to this channel to start the tone-generation (n9). If the event within the melody key range is an off-event, the tone- generation of the relevant channel is stopped (n10).

When the rhythm selector switch 81 is turned on, a selected rhythm type is set into the RHY register (n12). For the automatic accompaniment, this rhythm is tone-generated.

When the start/stop switch 82 is turned on, the control unit takes a sequence of n13 to n14 to invert the RUN flag (n14), thereby deciding whether the RUN flag has been set or not (n15). With the flag set, it then decides whether the ad-lib flag ADLB has been set or not (n16). The ad-lib flag ADLB, as described later, is set when the ad-lib switch 83 is turned on. With the switch 83 reset, since neither the rhythm tone nor the ad-lib tone is currently generated, the control unit performs the setting of data for starting the generation of rhythm tone and the setting of data for turning on the ad-lib switch on the way of automatic accompaniment. More specifically, it first searches the ad- lib pattern corresponding to the rhythm type, setting the leading address thereof into the ADPNT (n17). It then clears the RDCNT and CLK (n18 and n19) to execute the operation of reading processing (FIG. 6) (n20). In this reading operation, the tone data stored at the leading head of the ad-lib data is read. On the other hand, since the automatic accompaniment is terminated when the RUN flag is reset at n15, the control unit turns off all the automatic accompaniment tones (n21), jumping to n22. Further, with the ad-lib flag ADLB set at n16, since the ad-lib tone is being generated, it jumps to n22 without doing any initializing processing (n17 through n20) for ad-lib tone generation.

At n22, the control unit decides whether an event of the ad-lib switch has occurred or not. If an ad-lib switch event occurs, it decides whether the event is an on- or off- event (n23), setting both the ADLB flag and the SNDEN flag for an on-event (n24 and n25) or resetting the ADLB flag for an off-event (n26). That is, the ad-lib tone generation is started (SNDEN=1) immediately when the ad-lib switch is turned on, whereas the ad-lib tone generation is not stopped immediately when the ad-lib switch is turned off, the tone generation being continued until it reaches a bar.

Subsequently, the control unit performs other processings (n27), returning to n2. While the system power is on, the unit repeats the operations of n2 to n27.

Figure 6:
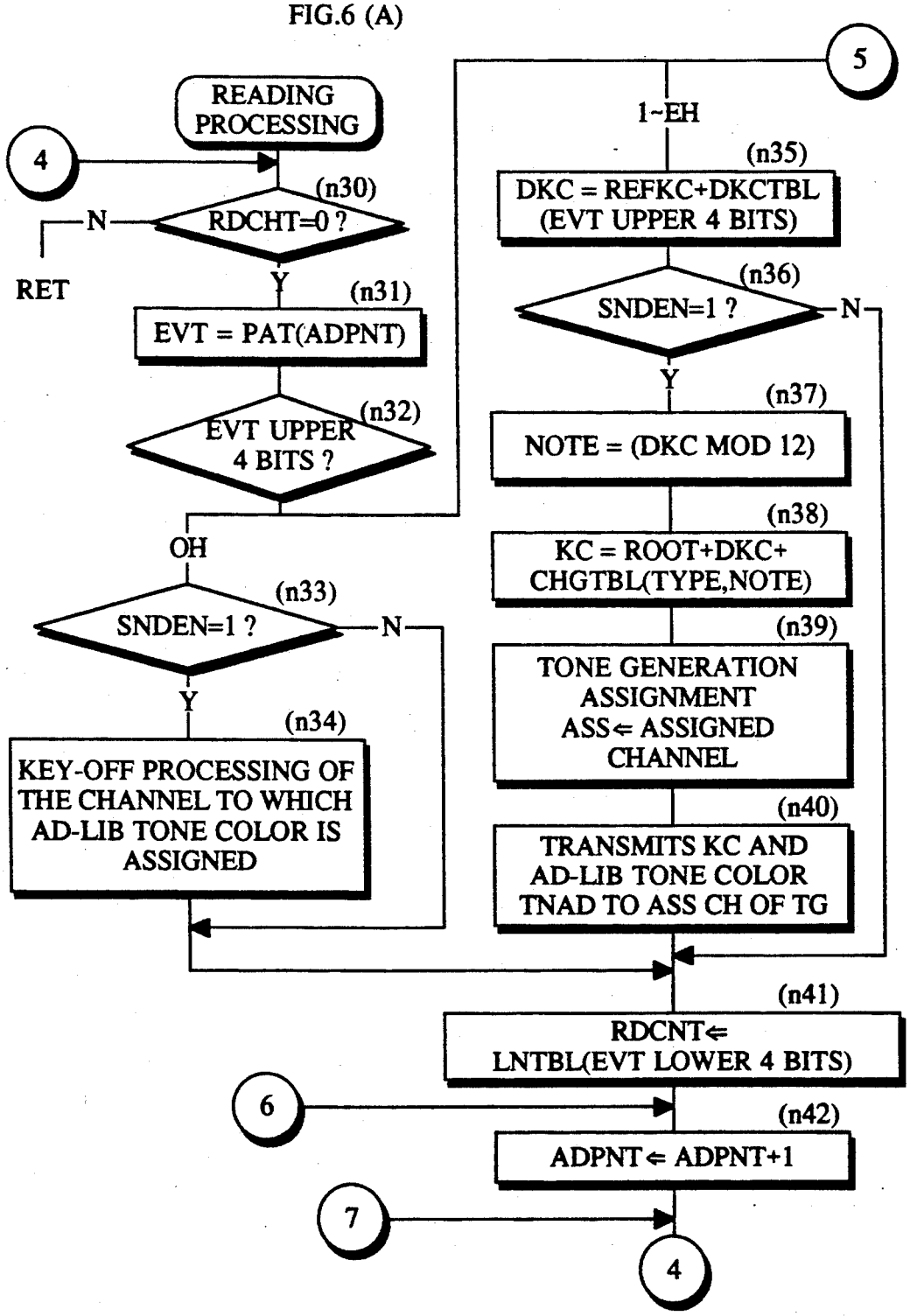
Figure 6B:
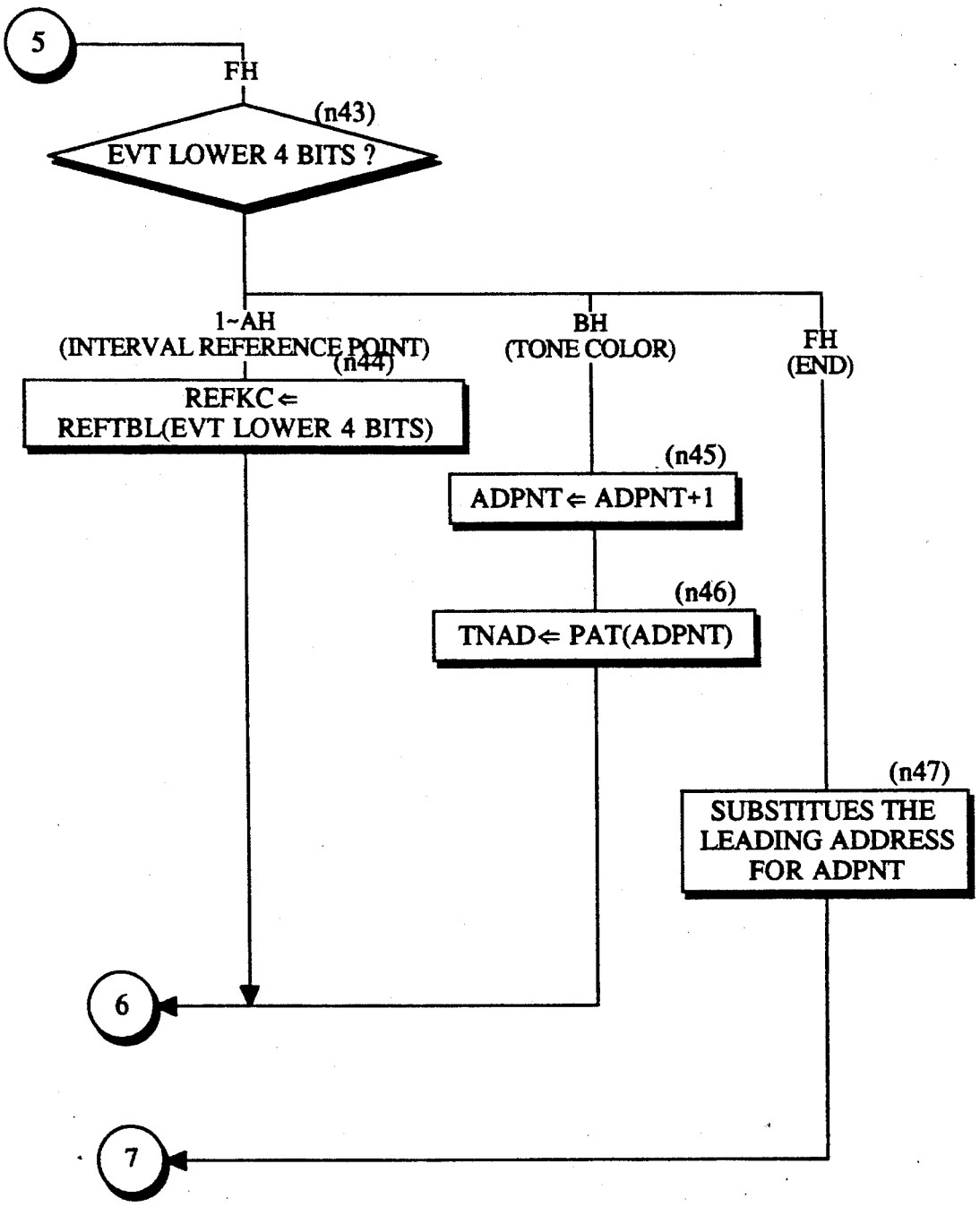

FIGS. 6(A) and 6(B) are flow charts showing the reading processing performed at the above-mentioned n20 and at n56. In this operation, ad-lib data is read which corresponds to the timing when the operation is executed. First, at 30, the control unit decides whether the note-length down counter RDCNT is 0 or not. With any count other than 0, it being no timing for reading of the next ad-lib data, the unit returns as it is. If the RDCNT is 0, the unit reads the next ad-lib pattern data PAT (ADPNT) into the EVT register (n31), deciding what is the contents of the upper 4 bits of the data stored in the EVT register (n32). The upper 4 bits of 0 means rest data, resulting in the execution of operations n33 and n34, while the upper 4 bits of 1 to EH mean note data, resulting in the execution of operations n35 through n40, and otherwise the bits of FH are control data to execute the sequence of operations starting with n43.

With the read data being rest data, when the operation goes to n33, the ad-lib tone-generation continuing flag SNDEN is decided in status, and if the SNDEN flag is set, the channel to which the ad-lib tone is assigned is key- off processed (n34). Then this is followed by n41, the length of the rest being set into the RDCNT register. If the SNDEN is reset, the operation goes directly to n41 from n33. That is, this reading processing is performed independently of the set/reset condition of the SNDEN, so that the operation of tone generation and degeneration is performed only while the SNDEN is set (refer to n36 through n40).

With the read data being note data, when the operation goes to n35, the control unit adds the interval reference point key code REFKC to the value of the upper 4 bits thereof to calculate the ad-lib key code, setting the result into the DKC register (n35). Then the unit decides the SNDEN flag in status (n36), and if it is set, it determines the pitch name of the ad-lib key code in order to correct the key code according to the type of chord, setting the result into the NOTE register (n37). This calculation can be carried out by the following equation:

$$NOTE = DKC. MOD. 12$$

With reference to the pitch-name conversion table using the resulting NOTE and TYPE, the key code KC to be actually tone-generated is determined by adding the reference result to the ROOT and DKC (n38). A channel is assigned to serve for the generation of this ad-lib tone, the channel number being stored into the ASS (n39). The KC and ad-lib tone TNAD are transmitted to the ASS channel of the tone generator to start the generation of the ad-lib tone (n40). Then the note length of this tone is determined by referencing the note-length table with the lower 4 bits of the EVP, being set into the RDCNT (n41). The address pointer ADPNT is added by 1 (n42), the operation returning to n30. When another note-length data is set, the unit returns as it is since the RDCNT is not 0.

If the upper 4 bits of the EVT are FH, the control unit decides the contents of the lower 4 bits at n43. If the lower 4 bits are any of 1 to AH, they stand for interval reference point change data, so that the unit references to the interval reference point table (FIG. 3 (C)) using the value of the lower 4 bits, setting the interval reference point data obtained therefrom into the REFKC (n44). Then this is followed by n42. At n43, if the lower 4 bits are BH, they stand for tone data. Since tone data is stored at the next address area, the unit adds the address pointer by 1 (n45), setting the contents stored in this address area into the TNAD (n46). This is followed by n42. At n43, if the lower 4 bits are FH, they stand for an end code, so that the ADPNT is replaced with the leading address to repeat the reading of the ad-lib melody data from the beginning thereof, the operation going to n30 (n47).

Figure 7:
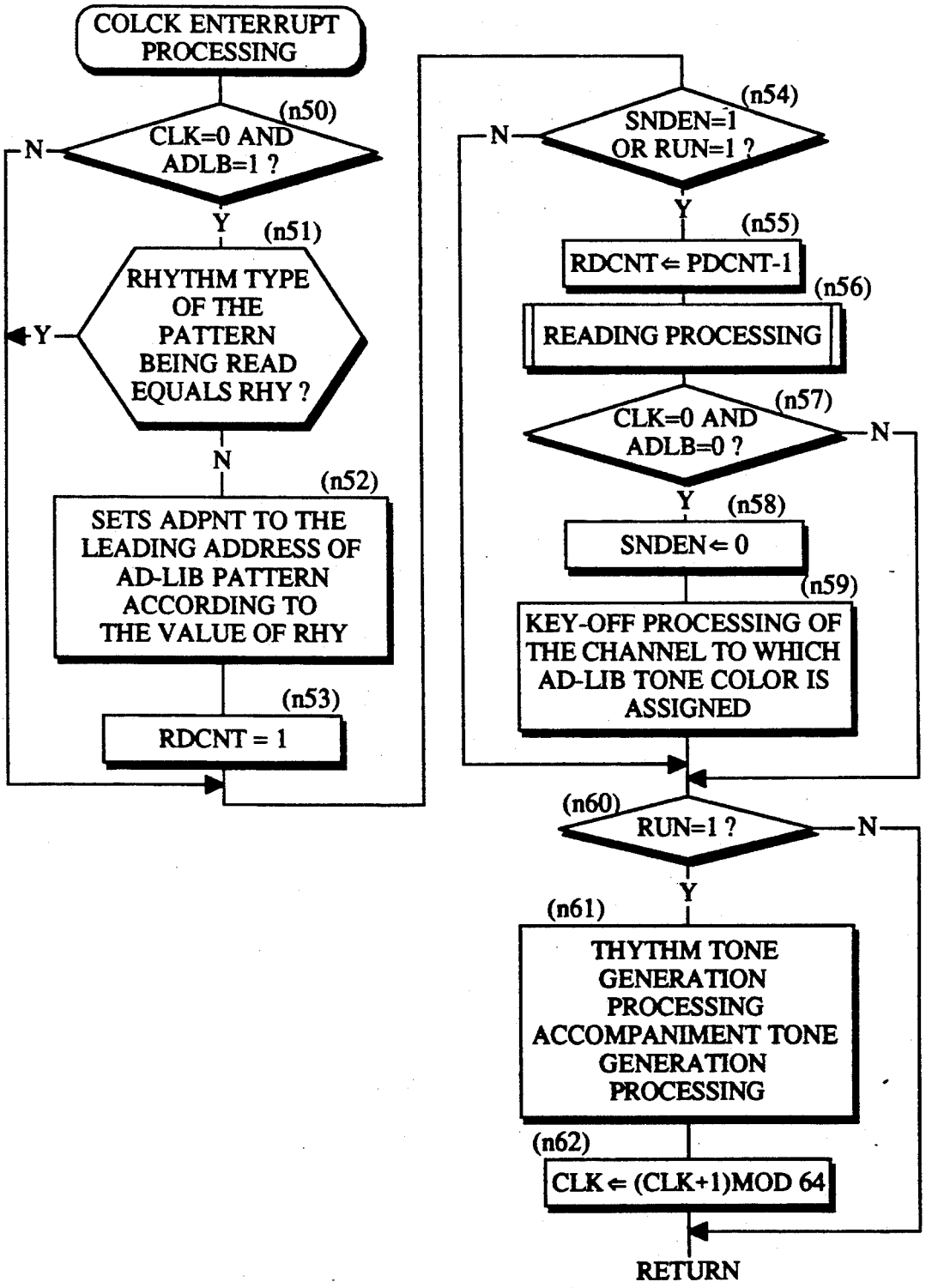

FIG. 7 shows the clock interrupt processing operation, in which timing control is performed for the generation of automatic accompaniment and ad-lib tones. First, at n50, the control unit decides whether the CLK is 0 and the ADLB is 1 or not. If both the conditions are satisfied, it is now the head of a measure and the ad-lib playing is designated, so that the unit decides whether the rhythm number of the rhythm type corresponding to the ad-lib pattern being read is equal to the current RHY in order to see if any change in rhythm type has occurred in the preceding measure or not (n51). If the number is not equal thereto, the ADPNT is set to the head of the ad-lib pattern corresponding to the current RHY (n52) and the RDCNT is set to 1 (n53), followed by n54. This processing makes it possible to complete the preparation for reading the ad-lib pattern that matches the type of the rhythm involved at the time when it reaches another measure, even if the rhythm type is changed in the preceding measure. If the conditions are not satisfied at n50, or if a proper pattern has been set at n51, the operation goes directly to n54.

At n54, the control unit decides whether either the SNDEN or RUN has been set or not. If at least any one of these is set, the RDCNT is subtracted by 1 at n55 so that the pointer ADPNT for reading ad-lib data is stepped on to execute the above-mentioned reading processing operation (n56). This operation is executed only if RUN=1 regardless of that SNDEN=0, causing the read ad-lib address to be moved whether the tone generation occurs or not. That the RDCNT is set to 1 at the starting point of ad-lib mode mentioned above (n53) is intended to make the RDCNT subtracted by 1 to result in 0 at n55. If the RDCNT is 0, the reading processing operation is executed. Next, the unit decides whether CLK=0 and ADLB=0 or not. If both the conditions are satisfied, it shows that the end point of a measure comes about with the ad-lib mode released, the unit resetting the SNDEN to cease the ad-lib playing (n58) and executing the key-off processing for the channel assigned to the ad-lib tone (n59).

Then at n60, the unit decides whether the RUN flag has been set or not. If it is set, it executes the processing for generating the rhythm tone according to the type of rhythm and the value of CLK, further executing the processing for generating the accompaniment tone according to the contents of the chord information, ROOT and TYPE (n61). Finally, after the stepping of CLK (n62), the operation returns. It is to be noticed here that the CLK is cleared when reaching 64. Hence, the value of CLK can be determined by the following equation:

$$CLK=(CLK+1).\ MOD.\ 64$$

If the RUN flag is reset, it directly returns from n60.

As shown above, since the electronic keyboard instrument according to the present invention is so arranged that it performs the stepping of the ad-lib data reading pointer ADPNT while the automatic rhythm accompaniment mode is active, it allows the reading location to be varied each time the ad-lib melody is tone-generated during the automatic accompaniment, enabling ad-lib melodies to be played in great variety. Moreover, even if the ad-lib switch is turned off, the instrument will continue playing the ad-lib until it stops at the end of the relevant measure, prohibiting the playing from being interrupted on the way thereof with the result of an automatic playing that eliminates any break of musical phrases.

Although in this embodiment ad-lib patterns are set according to a rhythm, several rhythms may be grouped so that ad-lib patterns can be provided for each group thereof. This allows the number of ad-lib patterns to be reduced. Furthermore, the tone-generation channels can be provided in any number thereof, making it also possible to provide a plurality of ad-lib tones. Conversions of key codes or the like may be performed by arithmetic method without using tables. In other aspects, although the present embodiment is adapted to generate the ad-lib tone only while the ad-lib switch is in the on position (depressed), the ad-lib switch may be an on/off invertor switch that allows the tone generation to be continued, once it is turned on, until turned off for the first time after that. The ad-lib switch need not to be provided as a special switch to be manually operated, but also may be provided either as a particular key on the keyboard or as a foot pedal switch. In addition, although the present invention has such an arrangement that when rhythm is changed during the playing of an ad-lib, the ad-lib pattern is changed starting with the head of the next measure, it may also be possible that the ad-lib pattern is immediately changed or that any change in the rhythm pattern is prohibited during the ad-lib playing.

Incidentally, ad-lib patterns involved may be ones previously preset or those which allow a player to optionally write in.

As described heretofore, according to the electronic musical instrument of this invention, since the clock value is counted up while the automatic accompaniment means thereof is being operated, whether any ad-lib tone is being generated or not, the tone generation is started with an indefinite location, allowing the playing of the instrument to be full of variety.

What is claimed is:

1. An electronic musical instrument with ad-lib playing function comprising:

ad-lib melody data storage means for storing ad-lib melody data;

ad-lib switch means being operable for initiating and terminating ad-lib melody playing;

clock means for generating clock pulses;

counter means for counting the generated clock pulses independent of an operation of the ad-lib switch means;

reading means, responsive to the ad-lib switch means, for reading the ad-lib melody data according to the counted number of clock pulses; and tone-generating means for generating tones corresponding to the ad-lib melody data read by the reading means.

2. An electronic musical instrument as claimed in claim 1, further comprising:

automatic accompaniment means for generating a chord; and an automatic accompaniment switch for activating the automatic accompaniment means, the automatic accompaniment switch having an ON-state and an Off-state, the automatic accompaniment means being activated when the automatic accompaniment switch is in the On-state, wherein said counter means counts said clock pulses when the automatic accompaniment switch is in the On-state.

3. An electronic musical instrument as claimed in claim 1, wherein said ad-lib melody data includes ad-lib melody data for each of a plurality of types of rhythms.

4. An electronic musical instrument as claimed in claim 1, wherein said reading means continues reading ad-lib data up to an end of a measure being played when said ad-lib switch means is operated to terminate ad-lib melody playing.

5. An electronic musical instrument as claimed in claim 1, wherein said ad-lib melody data includes note length data.

6. An electronic musical instrument as claimed in claim 1, wherein said ad-lib melody data includes note pitch data, the note pitch data being stored in accordance with a reference pitch.

7. An electronic musical instrument as claimed in claim 6, wherein said reference pitch is changeable in accordance with said ad-lib melody data.

8. An electronic musical instrument as claimed in claim 6, wherein said reference pitch is stored as coded data within said ad-lib melody data.

9. An electronic musical instrument as claimed in claim 1, wherein said ad-lib switch means is a manually operated push switch.

10. An electronic musical instrument as claimed in claim 1, wherein said ad-lib switch means is a manually operated toggle switch.

11. An electronic musical instrument as claimed in claim 1, wherein said ad-lib switch means is a pedal switch.

12. An electronic musical instrument as claimed in claim 1, including means for specifying a tempo, wherein the clock means generates clock pulses in accordance with the specified tempo.

13. An electronic musical instrument as claimed in claim 1, wherein the electronic musical instrument is operable in a first operating mode in which tones corresponding to the ad-lib melody data read from the ad-lib melody storage means are generated and a second operating mode in which tones corresponding to the ad-lib melody data read from the ad-lib melody data storage means are not generated, the electronic musical instrument including mode selecting means for selecting one of the first and second operating modes for the electronic musical instrument, the reading means being responsive to the mode selecting means for reading ad-lib melody data from the ad-lib melody data storage means.

14. An electronic musical instrument as claimed in claim 13, wherein said electronic musical instrument includes automatic accompaniment means for generating a chord, and wherein the mode selecting means comprises an automatic accompaniment switch for activating and deactivating the automatic accompaniment, the automatic accompaniment switch including an On-state and an Off-state, said counting means being operable to count the generated clock pulses when the automatic accompaniment switch is in the On-state.

* * * * *